US009393601B2

(12) United States Patent
Ronck

(10) Patent No.: US 9,393,601 B2
(45) Date of Patent: Jul. 19, 2016

(54) CONVERTIBLE WIPING DEVICE

(71) Applicant: Benjamin Tyson Ronck, Houston, TX (US)

(72) Inventor: Benjamin Tyson Ronck, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 474 days.

(21) Appl. No.: 13/906,454

(22) Filed: May 31, 2013

(65) Prior Publication Data

US 2014/0352725 A1 Dec. 4, 2014

(51) Int. Cl.

| | |
|---|---|
| ***B08B 9/00*** | (2006.01) |
| ***B08B 9/043*** | (2006.01) |
| ***E21B 33/16*** | (2006.01) |

(52) U.S. Cl.

CPC ..... *B08B 9/0436* (2013.01); *E21B 33/16* (2013.01)

(58) Field of Classification Search

None

See application file for complete search history.

(56) References Cited

U.S. PATENT DOCUMENTS

| | | | | |
|---|---|---|---|---|
| 7,413,020 | B2 * | 8/2008 | Carter | E21B 7/20 166/207 |
| 7,559,363 | B2 | 7/2009 | Howell et al. | |
| 7,673,688 | B1 | 3/2010 | Jones et al. | |
| 2005/0045341 | A1 * | 3/2005 | Cook | B21D 39/04 166/380 |
| 2005/0103493 | A1 | 5/2005 | Stevens et al. | |

OTHER PUBLICATIONS

Imhoff et al., "Composites Improve Well Construction Efficiency", SPE 125084, Copyright 2009, Society of Petroleum Engineers, 12 pages.

Halliburton, [online]; [retrieved on Aug. 19, 2013]; retrieved from the Internet http://www.halliburton.com/en-US/ps/cementing/casing-equipment/wiping-technology/default.page; "Wiping Technoloy"; Copyright © 2013 Halliburton; 1 pg.

* cited by examiner

*Primary Examiner* — Eric Golightly

(74) *Attorney, Agent, or Firm* — Cantor Colburn LLP

(57) ABSTRACT

A wiping device including a resilient body having a wiping surface. A support member is convertible between a first shape defined by a first center line of the support member and a second shape defined by a second center line of the support member. The support member is disposed relative to the resilient body to enable the resilient body to take a first set of dimensions when the support member is in the first shape and a second set of dimensions when the support member is in the second shape. A method of using a wiping device is also included.

18 Claims, 3 Drawing Sheets

CONVERTIBLE WIPING DEVICE

BACKGROUND

Various wiping devices, e.g., pump down plugs, pigs, wiper plugs, wiper darts, liner wipers, etc. are used in the downhole drilling and completion industry. Although these devices work for their intended purpose, each is not without its own advantages and tradeoffs. The industry would well receive advancements and alternate embodiments for wiping devices.

SUMMARY

A wiping device comprising a resilient body having a wiping surface; and a support member convertible between a first shape defined by a first center line of the support member and a second shape defined by a second center line of the support member, the support member disposed relative to the resilient body to enable the resilient body to take a first set of dimensions when the support member is in the first shape and a second set of dimensions when the support member is in the second shape.

A method of using a wiping device, comprising positioning the wiping device in a first tubular section, the wiping device having a support member and a resilient body; engaging a wiping surface of the resilient body with the first tubular section; moving the wiping device through the first tubular section to a second tubular section having dimensions differing from the first tubular section; converting the support member from a first shape defined by a first center line of the support member to second shape defined by a second center line of the support member; and engaging the wiping surface of the resilient body with the second tubular section.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
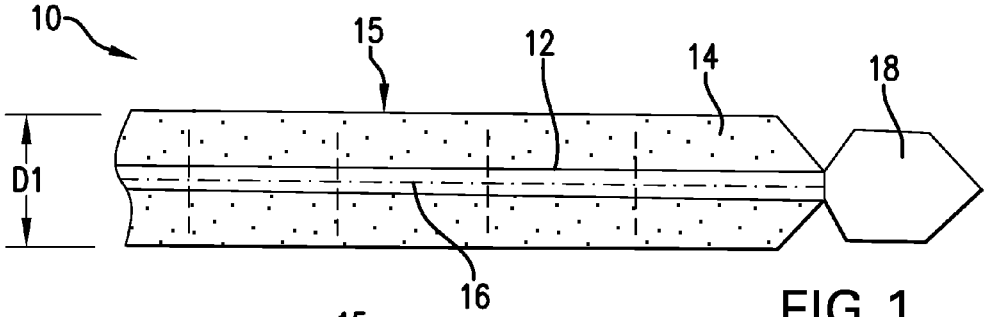
FIG. 1 schematically illustrates one embodiment of a wiping device having a first set of dimensions.

Referring now to FIG. 1, a wiping device 10 is illustrated. The wiping device 10 may be alternatively referred to as a pump down plug, wiper plug, pig, etc., and used to urge a fluid or substance through a tubular string. For example, as discussed in more detail below, wiper plugs are often used in borehole cementing operations to urge cement down a casing string and out through a port in the bottom of the casing string in order to cement an annulus between the casing string and a borehole in which the casing string is installed.

Figure 2:
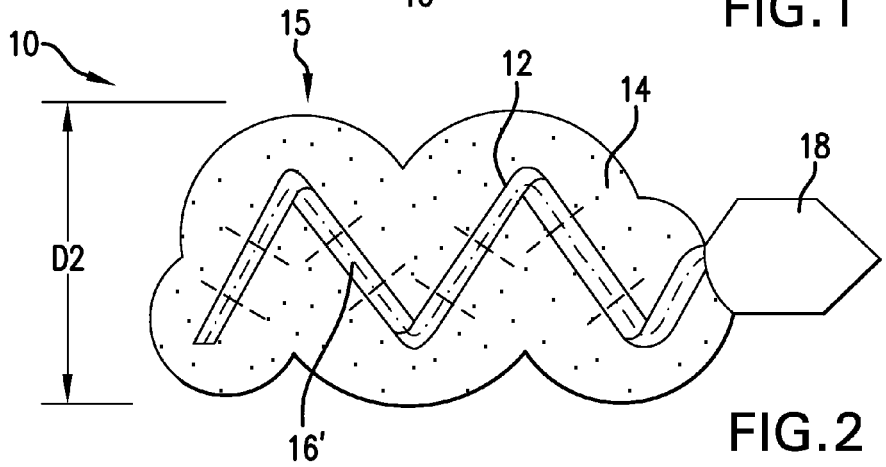
FIG. 2 schematically illustrates the wiping device of FIG. 1 having a second set of dimensions after converting a shape of a support member of the wiping device.

The wiping device 10 includes a support member 12 and a resilient body 14. The body 14 includes a wiping surface 15, e.g., that is arranged for engagement against a corresponding surface of a tubular member or string, or section thereof, to be wiped by the device 10. The support member 12 is configurable or convertible between at least a first shape, e.g., as shown in FIG. 1, and a second shape, e.g., as shown in FIG. 2. By changing the shape of the support member 12, the dimensions of wiping device 10 are also changed or altered. Namely, with respect to the illustrated embodiment, the wiping device 10 a first dimension D1 that corresponds to the first shape of the support member 12 (FIG. 1), and a second dimension D2 that corresponds to the second shape of the support member 12 (FIG. 2).

Figure 3:
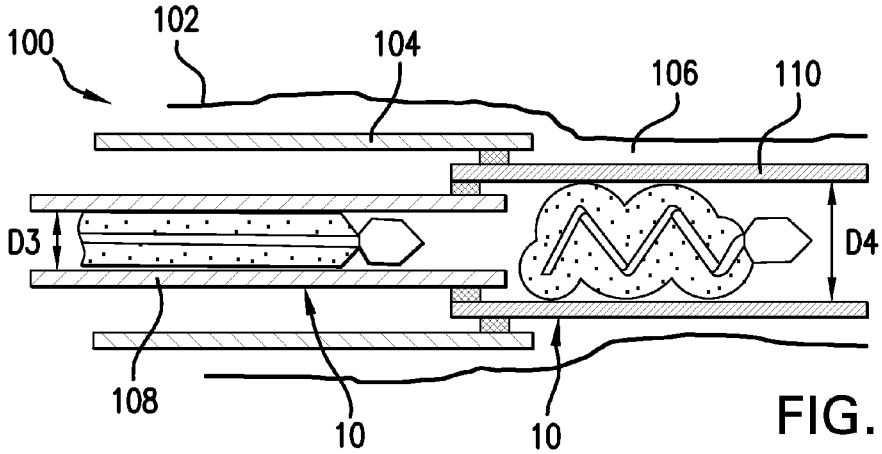
FIG. 3 is a cross-sectional view of a completion system including the wiping device of FIGS. 1 and 2 for wiping tubular sections having different dimensions.

Changing the dimensions of the wiping device 10 (e.g., from the dimension D1 to the dimension D2) enables a wiping surface 15 of the body 14 to be positioned or configured to wipingly engage with or against corresponding surfaces of tubular members of different sizes or different sections of a tubular member having different dimensions. For example, as shown in FIG. 3, a completion system 100 is illustrated for completing a borehole 102. The system 100 includes a casing string 104 that in one embodiment is intended to be cemented within the borehole 102, i.e., by filling an annulus 106 between the borehole 102 and all or a part of the casing string 104 with cement. Cement can be provided downhole via a running string 108, having a dimension D3. In the illustrated embodiment, the running string 108 terminates at or proximate to a liner 110 of the casing string 104, that is hung or otherwise secured to the upper portion of the casing string 102. The liner 110 has a dimension D4 that is larger than the dimension D3 of the running string. The wiping device 10 is arranged to be pumped downhole following the cement in order to urge the cement down through both the running string 108 and the liner 110 of the casing string 104. The liner 110 may terminate in a shoe or other ported components providing fluid communication with the annulus 104 to enable the cement to be pushed by the wiping device 10 into the annulus 106.

It is to be appreciated that despite the difference between the dimensions D3 and D4 of the running string 108 and the liner 110, the dimensional change of the wiping device 10, e.g., between the dimensions D1 and D2, as provided by the shape change of the support member 12, enables the wiping device 10 to wipe both the running string 108 and the liner 110. That is, the dimension D1 of the wiping device 10 positions the wiping surface 15 for engagement with the running string 108, while the dimension D2 positions the wiping surface 15 for engagement with the liner 110. The wiping device 10 is accordingly illustrated in its corresponding first and second configurations in the running string 108 and the liner 110, although it is to be understood that only a single wiping device need be run downhole to wipe both strings. Traditional completion systems require a plug or dart to wipe a running string, and a separate liner wiper, having enlarged radial dimensions, to wipe a liner. It is additionally to be appreciated that the running string 108 and the liner 110 represent just one example of dimension different tubular members, and that the wiping device 10 can be similarly utilized for wiping any other set of dimensionally different tubular members.

The support member 12 is defined by a length and a cross-sectional shape and area taken perpendicularly to the length at any of an infinite number of points along the length. For example, if the support member 12 is formed from a cylindrical rod or wire, the cross-sectional shape is circular and the area is defined by pi times the radius squared. Other cross sectional shapes are contemplated and will carry their own geometric nomenclature and mathematic calculation of area. The length is most easily determined as the longest dimension of the support member 12 and/or the dimension of the support member 12 that has an aspect ratio greater than one with respect to each of the other dimensions of the support member 12. The length of the support member 12 is designated in FIG. 1 by the reference numeral L1. It is to be understood that even after the support member 12 changes shape, e.g., from a longitudinally straight shape of FIG. 1 to a helical, coiled, or spiraling shape of FIG. 2, that the length of the support member 12 does not necessarily change significantly from the length L1. That is, the length of the support member 12 in FIG. 2 may also equal approximately the length L1, although the length L1 not shown in FIG. 2 because it follows a helical path that is not readily displayed in a two dimensional illustration. The other dimensions of the support member 12 such as width, thickness, diameter, etc., e.g., a radial dimension X, may also remain essentially unchanged. However, the dimensions of the shape that the support member 12 converts into (as opposed to the actual dimensions L1 and X of the support member 12 itself), as well as the corresponding dimensions of the device 10, will change due to the support member 12 converting between its various shapes.

It is to be appreciated in view of the above that by the support member 12 changing shape, it is meant that a center line of the support member 12 is physically reconfigured in order to change the overall dimensions of the shape formed by the support member 12, e.g., the dimensions D1 and D2 of the wiping device 10, but without necessarily changing the individual dimensions of the support member 12. For example, in the illustrated embodiment, the support member 12 in FIG. 1 takes the shape of a bar, rod, or wire that extends longitudinally along a first or initial center line 16, while the support member 12 in FIG. 2 takes a helical, spiral, or coil shape, e.g., resembling a coil spring, that follows a second or reconfigured center line 16'.

As used herein, "center line" (e.g., the center lines 16 and 16') means a line formed by connecting the center of each cross-section of the support member 12 taken along the length of the support member, e.g., at each instantaneous point along the length of the support member 12. Again, the length of the support member 12 does not necessarily extend along a longitudinally straight path, but could follow other shapes, e.g., the helical shape shown in FIG. 2 and others discussed below. The planes corresponding to several such cross-sections are represented by dashed lines in FIGS. 1 and 2. The center of any cross-sectional shape of the support member 12 can be determined, for example, as the center of mass, gravity, or area, e.g., assuming constant density of the support member 12 in each cross-section. For example, if the support member 12 has a circular cross section, the center lines 16 and 16' would be formed through the center point of each circle at each instantaneous cross-section along the length of the support member 12. In the first shape of FIG. 1, the center line 16 follows an essentially straight longitudinal path, while in the second shape of FIG. 2, the modified center line 16' takes a helical, curved, spiraling, or coiled path.

It is to be understood that although the individual dimensions of the support member 12 may remain essentially unchanged, the overall dimensions of the shape formed by the support member 12 will be changed by virtue of the misalignment between the center lines 16 and 16' of the support member 12. That is, the diameter, thickness, and/or width of the support member 12 are unchanged when transitioning between the shapes of FIGS. 1 and 2. It is additionally noted that, although the support member 12 follows a helically arranged path in FIG. 2 (as opposed to a straight path in FIG. 1), that the length of the support member 12 also remains unchanged. Thus, the dimensions of the wiping device 10 are maintained by the support member 12 solely by the shape that the support member 12 is converted or configured into, as defined by the center line of the support member 12, e.g., the center lines 16 and 16'.

In one embodiment, the support member 12 is formed as a resilient member that elastically resists deformation of the support member 12 from a natural of default shape. In one such embodiment, the support member 12 is formed as a coil spring or coiled wire that is straightened to result in the shape of FIG. 1. By feeding the wiping device 10 into a correspondingly sized tubular member (e.g., the running string 108), the wiping device 10 will be radially supported at the wiping surface 15 and resist conversion of the support member 12 to its coiled form. However, the resiliency of the spring or wire will enable the support member 12 to automatically convert back to the coiled shape when the wiping device 10 is moved from the relatively smaller dimensioned tubular member (e.g., the running string 108) to a relatively larger dimensioned tubular member (e.g., the liner 110).

In one embodiment, the support member is formed as a shape memory material, e.g., a shape memory alloy. In this way, the support member 12 can be configured to transition from the first shape defined by the center line 16 to the second shape defined by the center line 16' in response to a proper transition stimulus. In one embodiment, applying the transition stimulus includes heating the support member above a threshold temperature. The transition stimulus triggers the support member 12 to convert to a default or "remembered" shape, e.g., the coil shape defined by the center line 16'. For example, the support member 12 can be stretched or deformed into the shape of FIG. 1 defined by the center line 16 and then cooled (or otherwise have the transition stimulus removed) in order to lock or freeze the support member 12 in this shape. By heating the support member 12 (or applying another transition stimulus), the support member 12 will attempt to revert back to the coil shape defined by the center line 16'. In one embodiment, the transition stimulus relates to ambient downhole conditions, e.g., ambient downhole temperature.

The body 14 is made of a material suitably resilient to enable the change in shape of the support member 12 without the body 14 ripping, tearing, or becoming damaged by the support member 12 changing shape. The material 14 should also be selected such that reconfiguring the shape of the support member 12, e.g., between the first shape defined by the center line 16 and the second shape defined by the center line 16', changes the dimensions of the wiping device 10, as discussed above. In one embodiment, the body 14 is made from a resilient foam, which can be open cell or closed cell. If an open cell or otherwise fluid permeable foam is used, the foam can be provided with a fluid impermeable coating, e.g., a resilient elastomeric material, in order to facilitate the wiping device 10 to be propelled through a tubular member, e.g., the running string 108, via a pressurized fluid, while urging cement or other fluids down through the string with the wiping device 10.

The wiping device 10 can be provided with a nose or leading portion 18. The nose portion 18 can be configured to engage with and/or trigger tools during or at the end of its travel, e.g., within the completion system 100. For example, the nose portion 18 can be arranged to seal off a flow path through a component into which the wiping device 10 lands or is received, e.g., a landing collar positioned in the liner 110.

Figure 4:
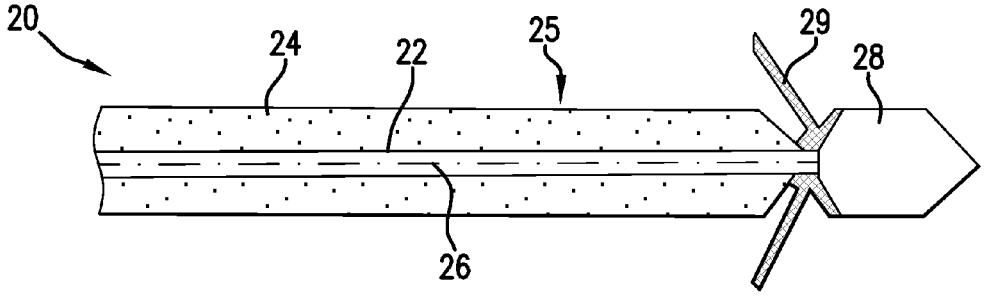
FIG. 4 schematically illustrates one embodiment of a wiping device having a first set of dimensions.
Figure 5:
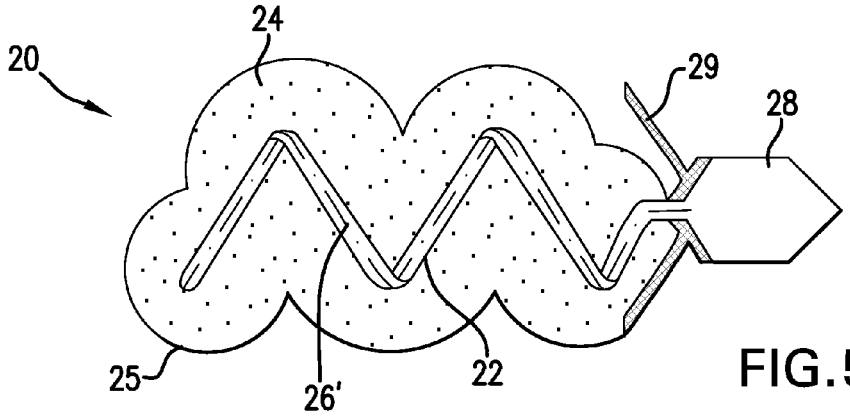
FIG. 5 schematically illustrates the wiping device of FIG. 4 having a second set of dimensions after converting a shape of a support member of the wiping device.
Figure 6:
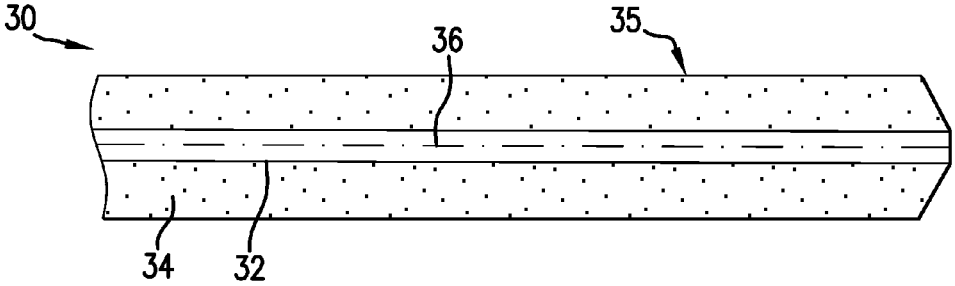
FIG. 6 schematically illustrates one embodiment of a wiping device having a first set of dimensions.
Figure 7:
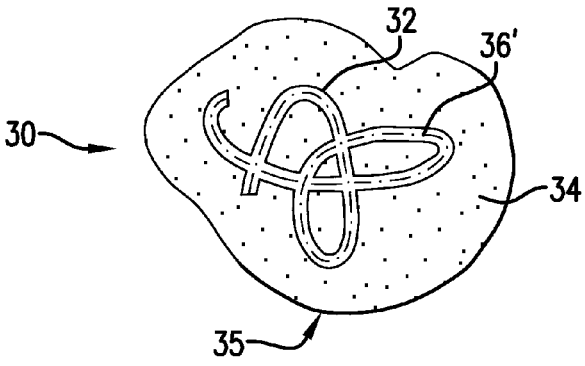
FIG. 7 schematically illustrates the wiping device of FIG. 6 having a second set of dimensions after converting a shape of a support member of the wiping device.
Figure 8:
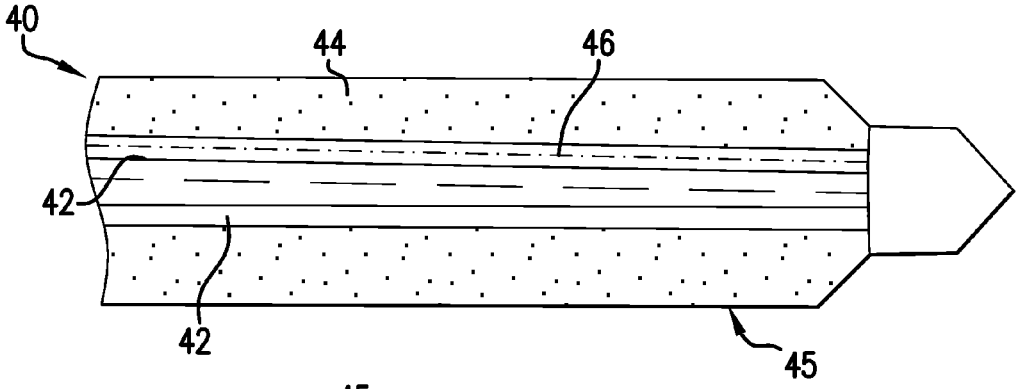
FIG. 8 schematically illustrates one embodiment of a wiping device having a first set of dimensions.
Figure 9:
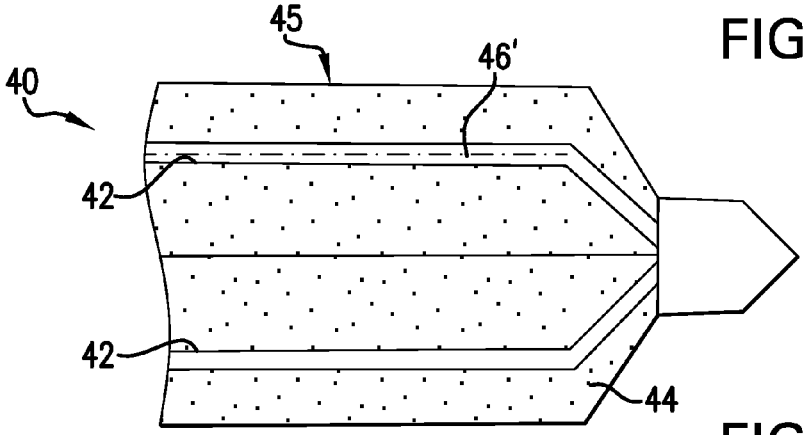
FIG. 9 schematically illustrates the wiping device of FIG. 8 having a second set of dimensions after converting a shape of a plurality of support members of the wiping device.
Figure 10:
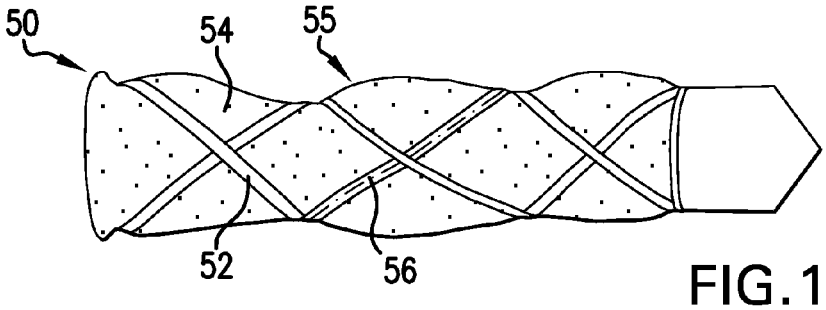
FIG. 10 schematically illustrates one embodiment of a wiping device having a first set of dimensions.
Figure 11:
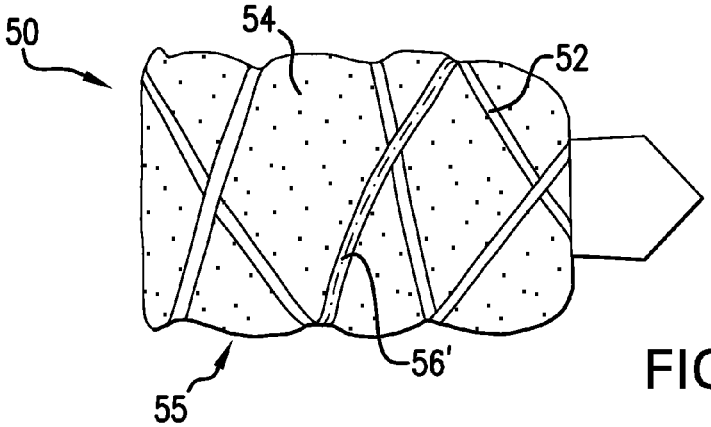
FIG. 11 schematically illustrates the wiping device of FIG. 10 having a second set of dimensions after converting a shape of a support member of the wiping device.

Various alternate embodiments are shown throughout FIGS. 4-11, namely, a wiping device 20 is shown in FIGS. 4-5, a wiping device 30 is shown in FIGS. 6-7, a wiping device 40 is shown in FIGS. 8-9, and a wiping device 50 is shown in FIGS. 10-11. Each of the devices 20, 30, 40, and 50 generally resembles the wiping device 10. For example, the devices 20, 30, 40, and 50 respectively include support members 22, 32, 42, and 52 that are each convertible between at least two shapes in order to change the dimensions of the respective wiping devices. Additionally, the devices 20, 30, 40, and 50 include respective resilient bodies 24, 34, 44, and 54 having respective wiping surfaces 25, 35, 45, and 55 for enabling the wiping devices to be used in wiping operations as discussed above with respect to the device 10.

The device 20 largely resembles the device 10. In addition to the support member 22 and the body 24, the device 20 transitions from a first shape defined by a first center line 26 that resembles the center line 16 to a second shape defined by a second center line 26' resembling the center line 16'. That is, the support member 22 of the device 20 is convertible between a longitudinally straight shape, e.g., resembling a rod, bar, or wire, in FIG. 4 and a coiled, helical, or spiraled shape in FIG. 5, similar to the device 10. The device 20 also includes a nose portion 28 resembling the nose portion 18 of the device 10. The device 20 largely differs from the device 10 by the presence of a secondary or additional wiper element 29. The wiper element 29 can be provided to assist the wiping surface 25 of the body 24 in performing a wiping operation, e.g., with respect to the miming string 108, the liner 110, or some other tubular member. The wiper element 29 can be generally one or more elastomeric wiping elements utilized in known pump down plugs and darts.

The support member 32 of the device 30 has a first shape, shown in FIG. 6, which is defined by a first center line 36 that generally resembles the center line 16, e.g., is formed in a bar, rod, or wire shape that follows a longitudinally straight path. However, unlike the center line 16', a second center line 36' of the device 30 takes an irregular, random, erratic, or inconsistent path that converts the body 34 into a jumbled or twisted mass, as shown in FIG. 7, in order to cause the associated dimensional change of the device 30. It is also noted that, unlike the devices 10 and 20, the device 30 does not include a nose portion. It is to be of course understood that other embodiments discussed herein can similarly include or exclude various components discussed herein.

The device 40 includes a plurality of the support members 42, each of which may undergo a shape change. In the illustrated embodiment, a first shape of the support members 42 generally resemble the first shapes of the device 10, 20, and 30, i.e., with a center line 46 of each of the support members 42 (only one of the center lines 46 shown) is formed in a longitudinally straight bar, rod, or wire shape, as shown in FIG. 8. The support members 42 are convertible into a second shape, shown in FIG. 9, in which the support members 42 form a bent or angled shape. It is noted that each of the first and/or second shapes taken by the support members 42 can be defined by center lines that do not necessarily resemble each other, e.g., the support members 42 can be arranged to convert into different shapes. Additionally, it is noted that multiple ones of the support members from other embodiments could be included, e.g., two initially straight support members that convert into coiled shapes that twist about each other.

The support members 52 of the device 50 are arranged to convert between a relatively tight coil, helix, or spiral shape defined by a first center line 56 to a relatively loose coil, helix, or spiral shape defined by a second center line 56'. In this way, the support members 52 can be utilized to initially hold the body 54 in a compressed or radially restricted shape, and loosen to enable the body 54 to radially enlarge in order to change the dimensions of the device 50. Radial expansion of the body 54 can be accomplished by swelling, e.g., upon contact with selected fluids, natural resiliency of the material of the body 54, shape memory properties of the body 54, etc., or any combination thereof. It is noted that the body 54 of the device 50 is contained within and/or wrapped exteriorly by the support members 52, while the resilient bodies of the devices 10, 20, 30, and 40 are disposed as jackets, sleeves, or covers surrounding or encapsulating their respective support members. It is also noted that the devices 10 and/or 20 could be similarly arranged such that the center lines 16 and/or 26 form shapes that resemble coils, helixes, or spirals that are relatively tighter than the shapes formed by the center lines 16' and/or 26' (e.g., do not extend as far radially outwardly).

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A wiping device comprising:

a resilient body having a wiping surface; and a support member convertible between a first shape defined by a first center line of the support member and a second shape defined by a second center line of the support member, the second centerline being distinct from the first centerline, the support member disposed relative to the resilient body to enable the resilient body to take a first set of dimensions when the support member is in the first shape and a second set of dimensions when the support member is in the second shape.

2. The wiping device of claim 1, wherein the first shape generally resembles a longitudinally straight bar, rod, or wire.

3. The wiping device of claim 1, wherein the second shape generally resembles a coil, helix, or spiral.

4. The wiping device of claim 3, wherein the second shape generally resembles a relatively looser coil, helix, or spiral.

5. The wiping device of claim 4, wherein the support member is wrapped exteriorly about the resilient body.

6. The wiping device of claim 1, wherein the second shape generally resembles includes a bend or angle.

7. The wiping device of claim 1, wherein the second shape is irregular, random, or inconsistent.

8. The wiping device of claim 1, wherein the resilient body surrounds or encapsulates the support member.

9. The wiping device of claim 1, wherein the support member is wrapped exteriorly about the resilient body.

10. The wiping device of claim 1, comprising a plurality of the support members.

11. The wiping device of claim 1, wherein the first set of dimensions is relatively radially smaller than the second set of dimensions.

12. The wiping device of claim 1, further comprising a nose portion.

13. The wiping device of claim 1, further comprising at least one wiping element mounted to the support member.

14. The wiping device of claim 1, wherein the support member at least partially comprises a shape memory material.

15. The wiping device of claim 1, wherein the support member at least partially comprises a resilient material.

16. A completion system for a borehole comprising a wiping device having a resilient body having a wiping surface; and a support member convertible between a first shape defined by a first center line of the support member and a second shape defined by a second center line of the support member, the second centerline being distinct from the first centerline, the support member disposed relative to the resilient body to enable the resilient body to take a first set of dimensions when the support member is in the first shape and a second set of dimensions when the support member is in the second shape.

17. The completion system of claim 16, further comprising a first tubular section having a third set of dimensions engagable with the wiping surface when the wiping device takes the first set of dimensions and a second tubular section having a fourth set of dimensions engagable with the wiping surface when the wiping device takes the second set of dimensions.

18. The completion system of claim 17, wherein the first tubular section is formed by a running string, and the second tubular section is formed by a liner of a casing string.

* * * * *